US010034567B2

(12) United States Patent
Billue

(10) Patent No.: US 10,034,567 B2
(45) Date of Patent: Jul. 31, 2018

(54) METHOD AND APPARATUS FOR BUILDING MAILBOX ASSEMBLIES

(71) Applicant: Scattered Mind Innovations, LLC, Weatherford, TX (US)

(72) Inventor: Jimmy Billue, Weatherford, TX (US)

(73) Assignee: Scattered Mind Innovations, LLC, Weatherford, TX (US)

( * ) Notice: Subject to any disclaimer, the term of this patent is extended or adjusted under 35 U.S.C. 154(b) by 94 days.

(21) Appl. No.: 14/902,571

(22) PCT Filed: Jul. 3, 2014

(86) PCT No.: PCT/US2014/045443
§ 371 (c)(1),
(2) Date: Jan. 3, 2016

(87) PCT Pub. No.: WO2015/003148
PCT Pub. Date: Jan. 8, 2015

(65) Prior Publication Data

US 2016/0166100 A1 Jun. 16, 2016

Related U.S. Application Data

(63) Continuation of application No. PCT/US2014/045452, filed on Jul. 3, 2014.

(60) Provisional application No. 61/842,496, filed on Jul. 3, 2013.

(51) Int. Cl.
*A47G 29/12* (2006.01)

(52) U.S. Cl.
CPC ..... *A47G 29/1216* (2013.01)

(58) Field of Classification Search
CPC ..... A47G 29/1209; A47G 29/1216
USPC ..... 232/17, 45, 38, 39
See application file for complete search history.

(56) References Cited

U.S. PATENT DOCUMENTS

| | | | | |
|---|---|---|---|---|
| 1,992,640 | A | 2/1935 | Steen | |
| 2,781,964 | A | 2/1957 | Ledgerwood | |
| 3,864,267 | A | 2/1975 | Nelems | |
| 4,875,622 | A | 10/1989 | Lents | |
| 6,109,519 | A * | 8/2000 | McClure | A47G 29/1216 232/17 |
| 6,123,257 | A | 9/2000 | Guidicy | |
| 6,234,387 | B1 | 5/2001 | Cuthbert | |

(Continued)

OTHER PUBLICATIONS

Search Report and Written Opinion of the International Searching Authority dated Nov. 3, 2014 from counterpart PCT App. No. PCT/US2014/045452.

(Continued)

*Primary Examiner* — William Miller
(74) *Attorney, Agent, or Firm* — James E. Walton

(57) ABSTRACT

A mailbox assembly includes a replacement mailbox having an outer surface, a rib extending along the outer surface of the replacement mailbox, a notification device secured to a front end of the replacement mailbox. A method to replace a damaged mailbox includes providing a replacement mailbox having a geometric shape smaller than a geometric shape of the damaged mailbox, sliding the replacement mailbox within the damaged mailbox, and securing the replacement mailbox at a spaced distance within the damaged mailbox with a rib secured to an outer surface of the replacement mailbox.

6 Claims, 7 Drawing Sheets

(56) References Cited

U.S. PATENT DOCUMENTS

| | | | | |
|---|---|---|---|---|
| 6,244,505 | B1 * | 6/2001 | Grimes | A47G 29/1209 232/17 |
| 6,347,737 | B1 * | 2/2002 | Madruga | A47G 29/22 232/34 |
| 6,375,071 | B1 * | 4/2002 | Kim | A47G 29/1209 232/33 |
| 6,425,521 | B1 | 7/2002 | Cooper | |
| 6,644,543 | B2 * | 11/2003 | Cox | A47G 29/16 232/38 |
| 7,093,747 | B1 | 8/2006 | Marchese | |
| 7,163,140 | B1 * | 1/2007 | Kaiser | A47G 29/1216 232/38 |
| 2007/0044413 | A1 | 3/2007 | Gossett, III | |

OTHER PUBLICATIONS

International Preliminary Report on Patentability dated Jul. 7, 2015 from counterpart PCT App. No. PCT/US2014/045452.

Search Report and Written Opinion of the International Searching Authority dated Nov. 3, 2014 from counterpart PCT App. No. PCT/US2014/045443.

International Preliminary Report on Patentability dated Jun. 24, 2015 from counterpart PCT App. No. PCT/US2014/045443.

* cited by examiner

METHOD AND APPARATUS FOR BUILDING MAILBOX ASSEMBLIES

BACKGROUND

1. Field of the Invention

The present application relates generally to mailbox assemblies.

2. Description of Related Art

Mailbox assemblies are well known in the art. For example, FIG. 1 depicts a conventional mailbox assembly 101 having a mailbox 103 carried by a support structure 105. Conventional mailboxes are typically manufactured with an inexpensive thin metallic material, e.g., steel, which is very susceptible to rusting over time. In the exemplary embodiment, structure 105 is a masonry structure, which is typically manufactured with brick, mortar, and wood.

Common problems associated with assembly 101 includes: rain can seep through the brick and mortar, which in turn causes the metallic mailbox 103 to rust and the documents therein damaged; wood is typically utilized to add rigidly to the structure and/or utilized to support the mailbox, however, the wood causes undesired swelling with humidity, which may result in the mortar and/or brick cracking; and, currently there is no easy, cheap, and rapid method to remove mailbox 103 from structure 105 when either the mailbox and/or the structure is damaged.

Conventional methods to remove mailbox and/or to fix the damaged structure includes the arduous process of disassembling and thereafter reassembling the rigid structure. This process is time consuming and expensive, and often requires a skilled worker.

Although the foregoing developments in mailbox assemblies, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
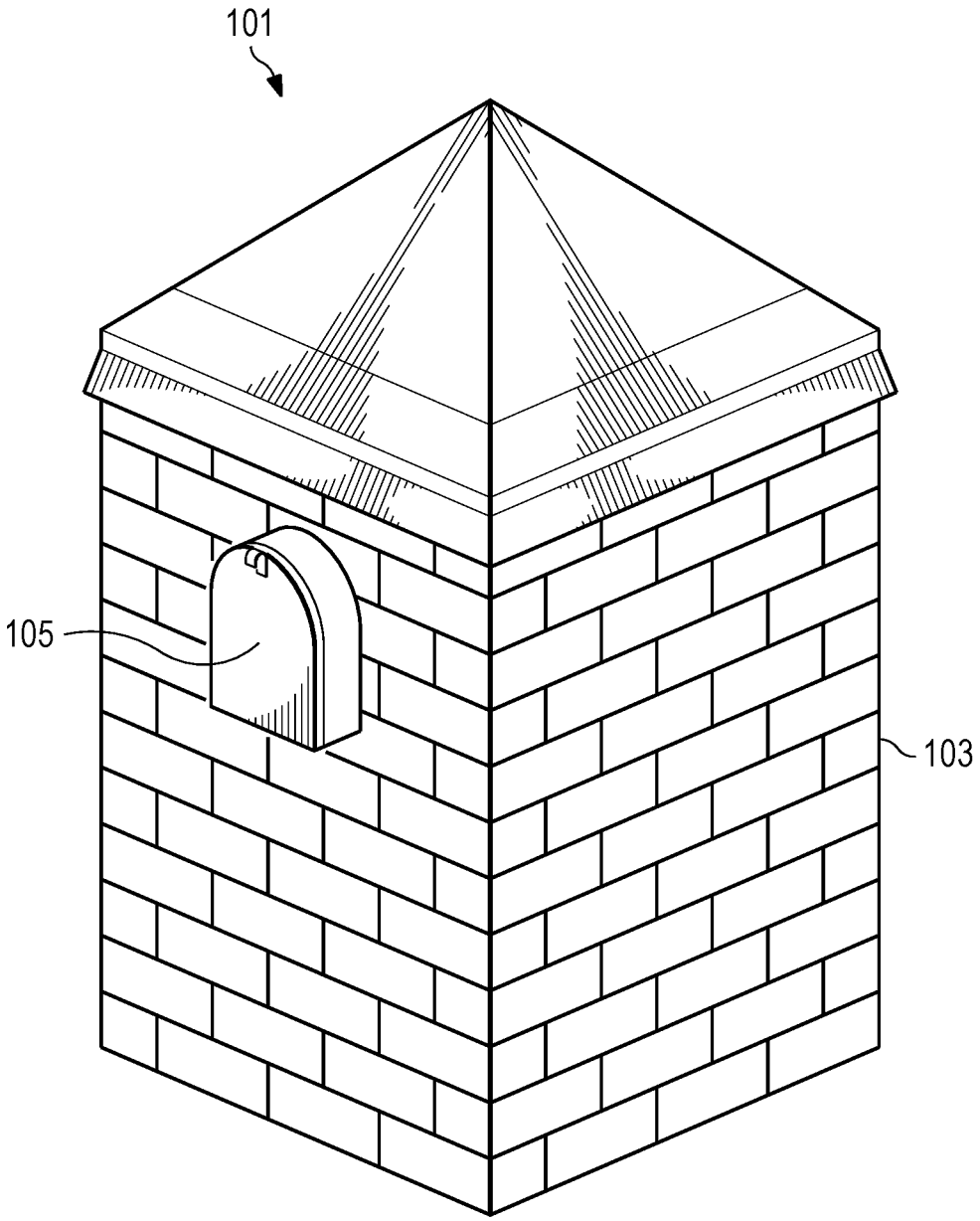
FIG. 1 (PRIOR ART)
FIG. 1 is an oblique view of a conventional mailbox assembly.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the apparatus and method are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The mailbox assembly of the present application overcomes the above-listed problems commonly associated with conventional mailbox assemblies. Specifically, the mailbox assembly includes a diverter configured to divert water away from the mailbox. This feature reduces and/or prevents moisture buildup from rusting the mailbox. A retainer is utilized to rigidly support the diverter and the mailbox to the support structure. This feature allows the mailbox to be rigidly supported to the structure, thereby reducing the need for additional materials. The assembly is further provided with a sleeve that secures the mailbox at a distance relative to the diverter or retainer. One advantage of the sleeve is to allow airflow at least partially around the mailbox so as to prevent rusting. The sleeve is also utilized as means to remove the mailbox from the structure.

In a secondary embodiment, a replacement mailbox is contemplated. The replacement mailbox is manufactured slightly smaller than the damaged mailbox and is configured to slide within the damaged mailbox for an easy and rapid fix. The replacement mailbox significantly reduces the time and cost associated with replacing damaged mailboxes, and does not require the use of a skilled worker. Further detailed description of these features are provided below and illustrated in the accompanying drawings.

The assembly and method of the present application will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-6 depict a mailbox assembly 201 in accordance with a preferred embodiment of the present application.

Mailbox assembly 201 preferably includes one or more of a mailbox 203 secured to a support structure 205. In the exemplary embodiment, structure 205 is manufactured with mortar and brick material and mailbox 203 has a curved top portion; however, the features of assembly 201 discussed herein could be utilized with other types of mailboxes and support structures manufactured with different materials and having different structural shapes and sizes.

One unique feature believed characteristic of assembly 201 is the feature of diverting moisture from mailbox 203. Diverting moisture helps prevent the undesired effects of rusting, which in turn can cause damage to the documents stored within the mailbox. To achieve this feature, assembly 201 utilizes a diverter 207, which is preferably a rigid waterproof structure that diverts water away from the mailbox via one or more grooves and/or merely by the structural curvature. Diverter 207 is composed of a sufficiently rigid material to support brick and mortar weight thereagainst without compromising the structural integrity. In the contemplated embodiment, diverter 207 is manufactured with a Styrofoam™ material having a height relatively equal to the bricks, e.g., 3-inches. However, it is also contemplated utilizing diverters manufactured with other materials capable of achieving the above-described features in alternative embodiments.

Another unique feature believed characteristic of assembly 201 is the method of securing mailbox 203 to structure 205. In the exemplary embodiment, structure 205 includes a plurality of bricks stacked in a rectangular column, which in turn forms a hollow cavity (not shown). The hollow cavity is typically filled with brick, mortar, wood, and/or other materials; however, water remains capable of escaping the filled cavity. It will be appreciate that assembly 201 utilizes a retainer 209 configured to rigidly attach to structure 205 and to hold mailbox 203 in a secured position either within the cavity and/or above materials disposed within the cavity.

Figure 2:
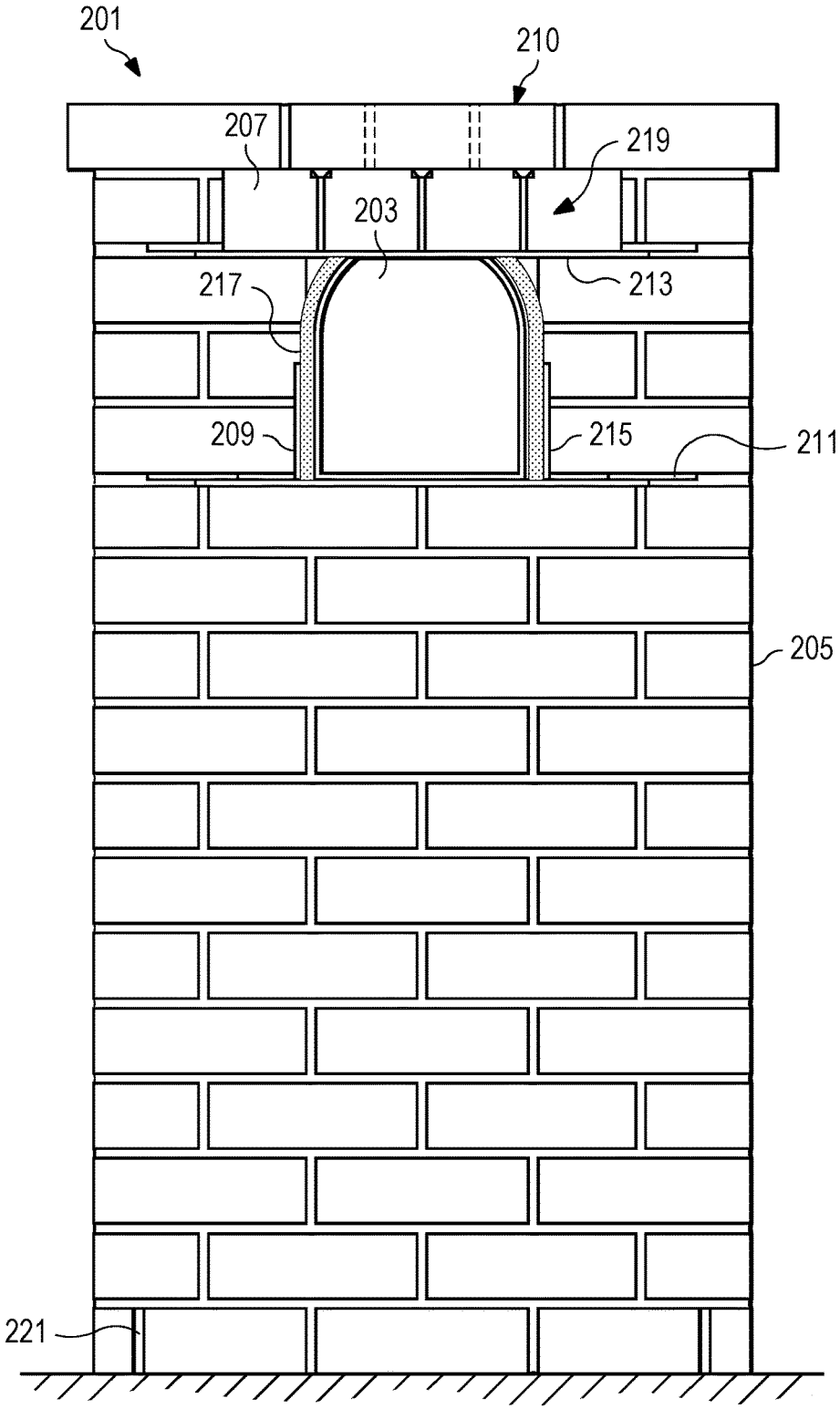
FIG. 2 is a front view of a mailbox assembly according to a preferred embodiment of the present application.

FIG. 2 depicts a preferred embodiment of structure 205 having a relatively flat top surface 210. Alternative embodiments could include a top surface having different shapes and sizes in lieu of the preferred embodiment, for example, see FIGS. 11 and 12. Disposed within structure 205 is retainer 209, which preferably includes a lower support 211 adapted to secure mailbox 203 to structure 205 and an upper support 213 adapted to secure diverter 207 to structure 205. In one embodiment, upper support 213 rigidly attaches to lower support 211 via a vertical member 215; however, as shown in FIG. 2, the supports can be separated and vertical member 215 could extend partially between the upper and lower supports.

Another unique feature believed characteristic of assembly 201 is the feature of removing mailbox 203 from retainer 209 or diverter 207. To achieve this feature, assembly 201 includes one or more sleeves 217 disposed between mailbox 203 and retainer 209 or diverter 207. In the contemplated embodiment, sleeves provide sliding engagement between the mailbox and the retainer or diverter, thereby allowing easy removal. The sleeves also rigidly secure the mailbox to the retainer. Other embodiments could include the process of rigidly attaching the sleeve to either the retainer or diverter, e.g., via an adhesive, then breaking apart the sleeve during the removal process. Sleeve 217 is preferably composed of a Styrofoam™ material; however, other materials are also contemplated in alternative embodiments. In the exemplary embodiment, sleeve 217 is securely held in position via one or more vertical members 215.

Assembly 201 preferably includes a plurality of sleeves 217 to create gaps between mailbox 203 and retainer 209 or diverter 207. The gaps can be located alongside, below, or on the top portion of mailbox 203. It will be appreciated that the gaps provide air circulation at least partially around mailbox 203, which in turn allows during of moisture buildup with air circulation. The circulation of air is one effective mean to dry the moisture buildup and to prevent rusting.

It is also contemplated having additional voids 219 around the diverter 207 to facilitate airflow and/or water passage. Lastly, one or more weep holes 221 are associated with gap 501 and voids 219 to further facilitate airflow and/or water passage. It will be appreciated that alternative embodiments could include air passages through the structure itself, thereby enhancing air circulation. The combination of utilizing gaps, voids, and weep holes provides sufficient circulation to prevent rusting. It should be understood that conventional mailboxes are not configured to allow sufficient airflow, resulting in the mailbox rusting over time. The sleeves 217 overcome this adverse affect by allowing airflow.

Figure 3:
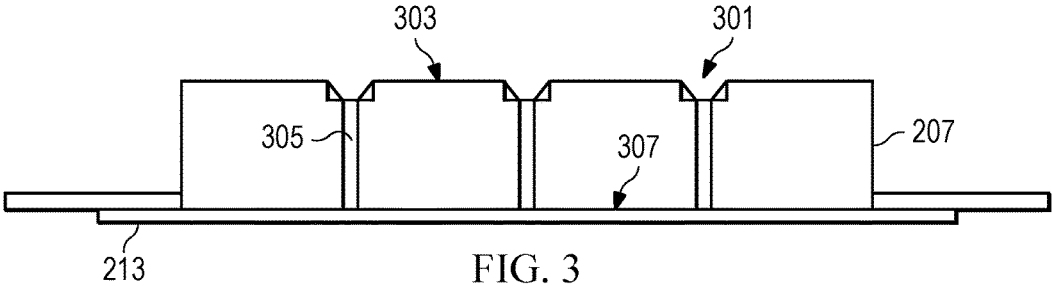
FIG. 3 is a front view of a diverter of the mailbox assembly of FIG. 2.

FIG. 3 depicts a front view of diverter 207 and upper support 213. Diverter 207 is optionally provided with one or more grooves 301 positioned on an upper surface 303 and configured to channel water away from mailbox 203. Another optional feature is the use of one or more channels 305 that extend from either groove 301 or surface 303 to a bottom surface 307. The channels are configured to channel water to a designated location.

Figure 4:
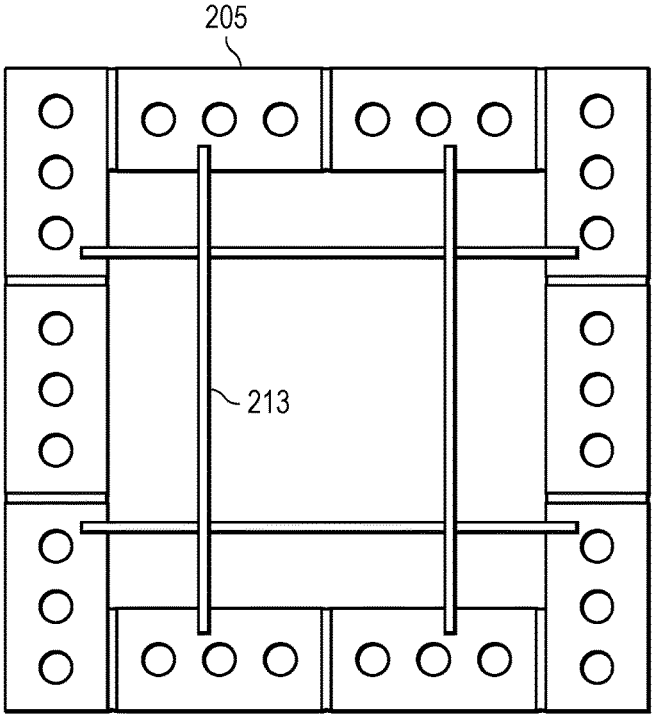
FIG. 4 is top view of a retainer of the mailbox assembly of FIG. 2.

FIG. 4 illustrates a top view of upper support 213 secured to structure 205. In the contemplated embodiment, support 213 includes a plurality of metal rods joined together to form a platform. It will be appreciated that alternative embodiments of diverter 207 could utilize different materials in lieu of the preferred metal rods.

Figure 5:
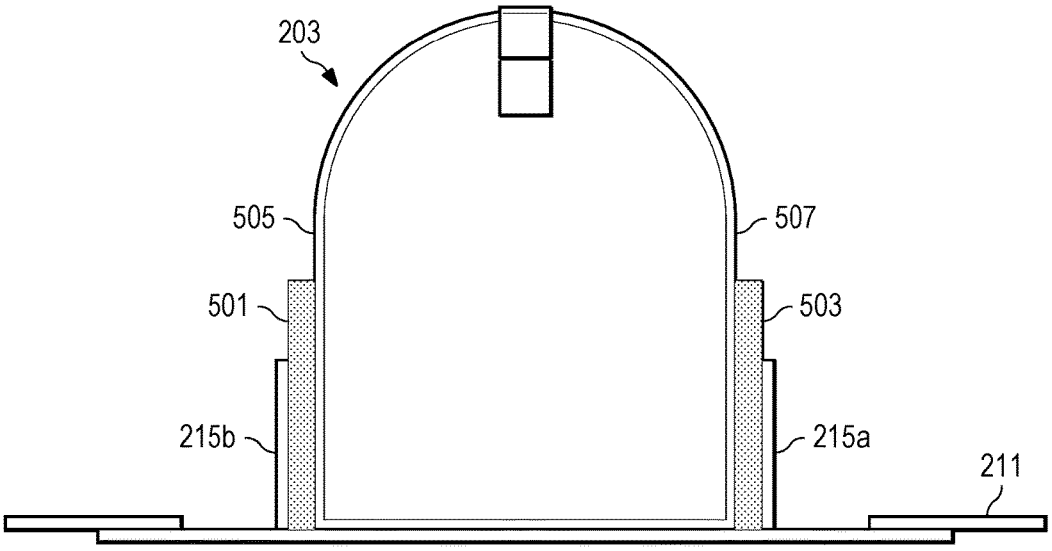
FIG. 5 is front view of the mailbox assembly and the retainer of FIG. 2.
Figure 6:
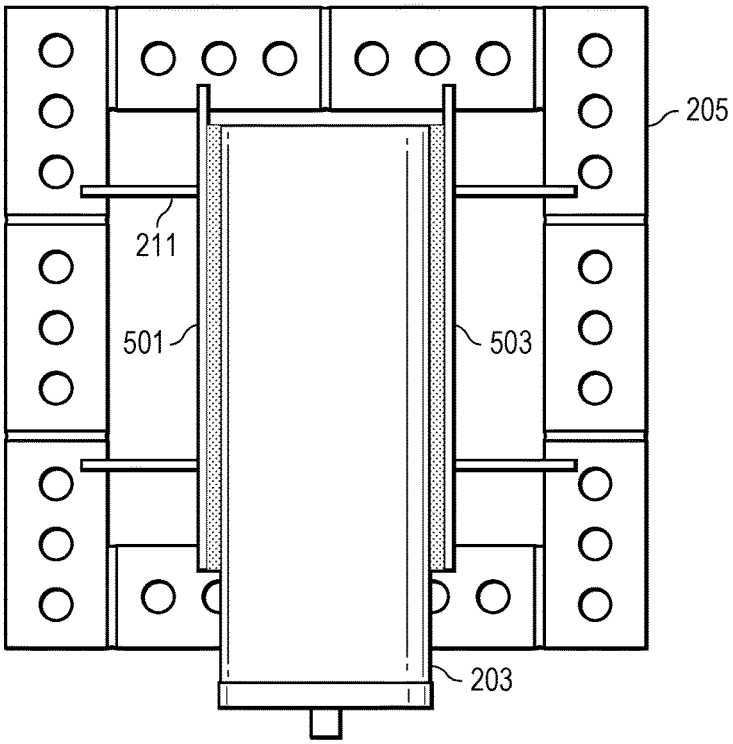
FIG. 6 is top view of the mailbox assembly of FIG. 2.

FIG. 5 is a front view of mailbox 203 supported by lower support 211. In this embodiment, the sleeves 501, 503 extend partially along the respective sides 505, 507 of mailbox 203. Thus, it is contemplated having sleeves that extend the entire length of the mailbox, and sleeves that extend along the sides, as illustrated in FIG. 5. Also, as illustrated, sleeves 501, 503 are securely supported via vertical members 215*a*, 215*b*. FIG. 6 illustrates a top view of mailbox 203 secured to structure 205 via lower support 211. It will be appreciated that sleeves 501, 503 can extend the entire length of mailbox 203 or be configured to extend partially or split in the middle to facilitate air circulation.

Figure 7:
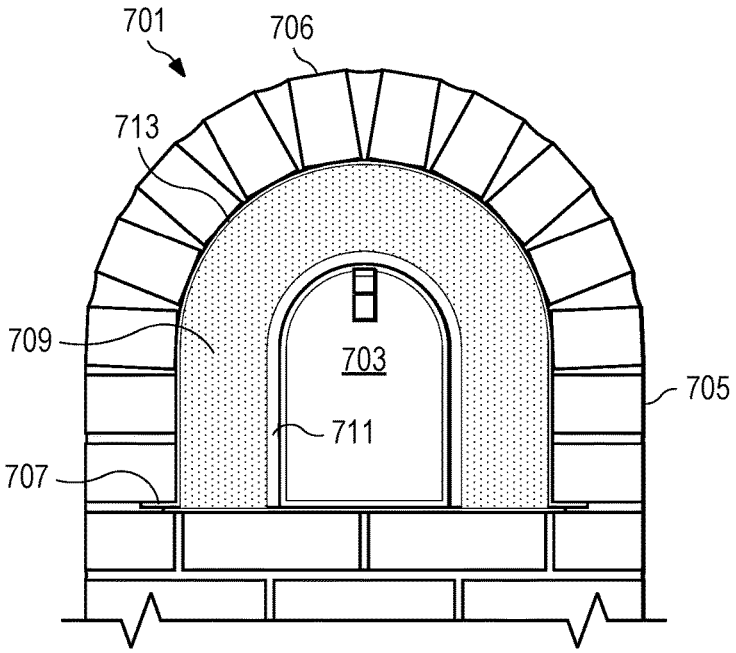
FIG. 7 is front view of a mailbox assembly according to an alternative embodiment of the present application.
Figure 8:
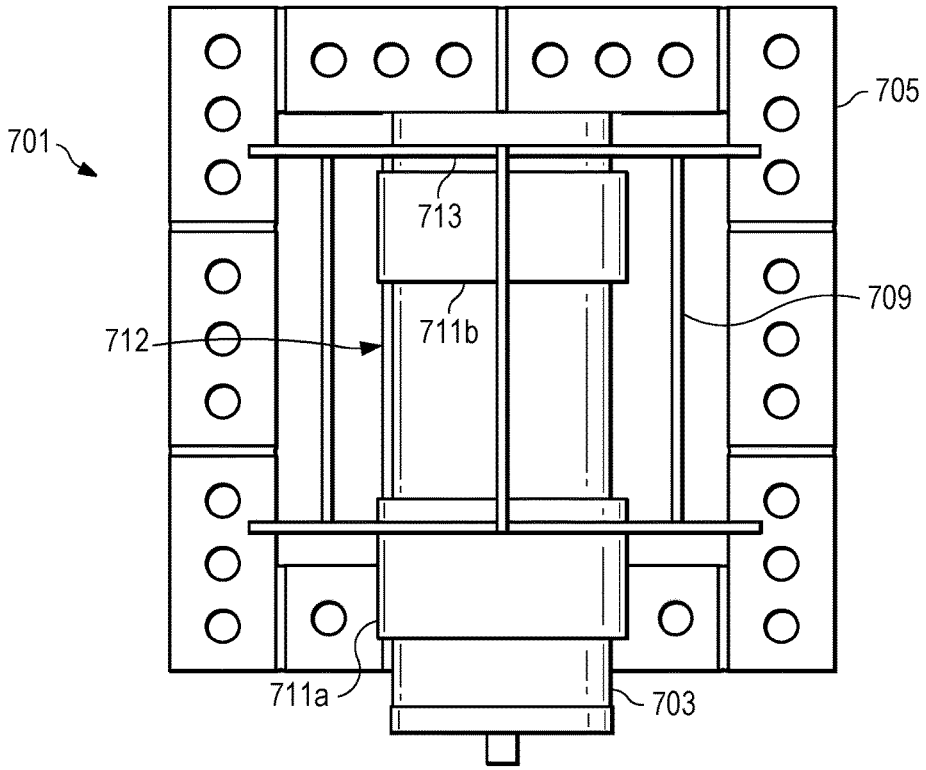
FIG. 8 is top view of the mailbox assembly of FIG. 7.

Referring now to FIGS. 7 and 8 in the drawings, respective front and top views of a mailbox assembly 701 are shown in accordance with an alternative embodiment of the present application. Mailbox assembly 701 is substantially similar in function to mailbox assembly 201, except in this embodiment, mailbox 701 is adapted for a structure having a rounded top surface. Thus, the features of both mailbox assemblies could share one of more features discussed herein.

Like assembly 201, mailbox assembly 701 is configured to prevent rusting and to provide quick and easy removal of the mailbox. Assembly 701 includes one or more of a mailbox 703 secured to a support 705. Unlike support 205, support 705 includes a rounded top 706. A retainer 707 is utilized to support both mailbox 703 and a diverter 709. Disposed between the mailbox and retainer is a sleeve 711. As shown in FIG. 8, a plurality of sleeves 711 could be utilized, e.g., sleeves 711*a*, 711*b*, as spaced apart to form voids 712 adapted to allow airflow around the mailbox.

Retainer 707 is further provided with one or more curved vertical support members 713, e.g., a wire frame, that extend along the sides and upper curved portion of mailbox 703. In the preferred embodiment, member 713 is configured to support both diverter 709 and sleeve 711 in fixed position. It will be appreciated that alternative embodiments could include a retainer that does not utilize member 713. Thus, in these embodiments, the bricks and mortar are placed directly on diverter 713.

Figure 9:
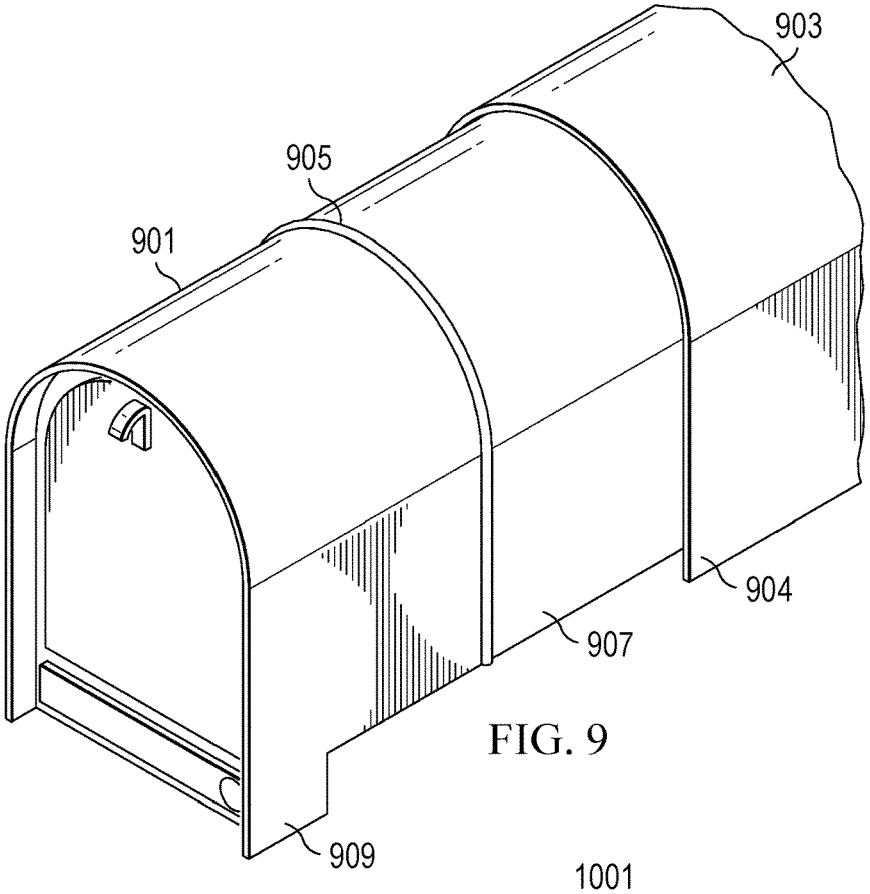
FIG. 9 is an oblique view of a replacement mailbox.
Figure 10:
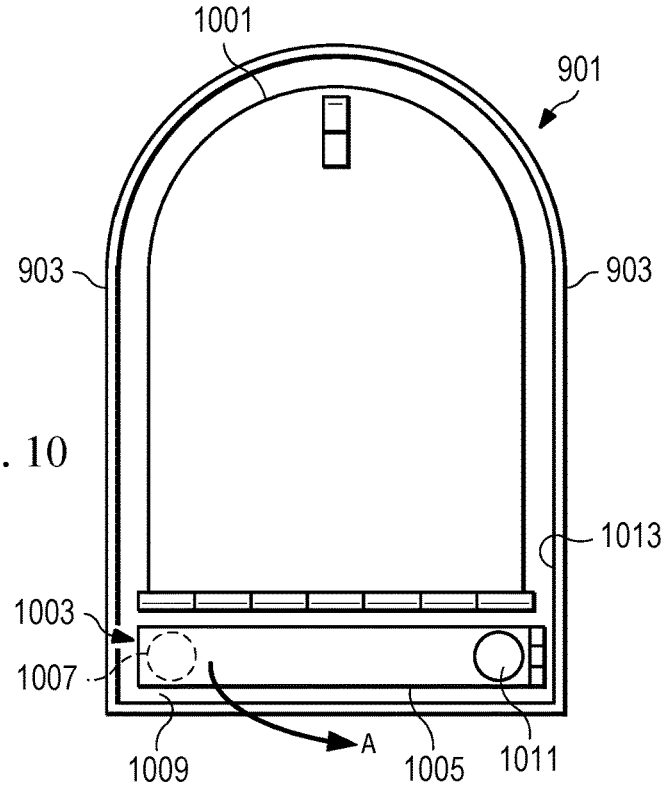
FIG. 10 is a front view of the replacement mailbox of FIG. 9.

Referring now to FIGS. 9 and 10, respective oblique and front views of an alternative embodiment of the present application are shown. In this embodiment, a replacement mailbox 901 is shown partially inserted into a damaged mailbox 903. During the replacement process, the front portion 904 of damaged mailbox 903 is removed and the body of replacement mailbox 901 is inserted into the damaged mailbox 903.

One unique feature believed characteristic of mailbox 901 is manufacturing the body of the replacement mailbox to be slightly smaller than the damaged mailbox. This feature provides a snug fit between the replacement mailbox and the damaged mailbox. In the contemplated embodiment, one or more ribs 905 are manufactured on an outer surface 907 of mailbox 901 to enhance the fit between the damaged mailbox and the replacement mailbox and also to provide air circulation therebetween.

Replacement mailbox 901 is provided with an edge 909 that fits against the support structure, which in turn prevents sliding movement of the replacement mailbox. In FIG. 10, the front view of mailbox 901 is shown. Mailbox is provided with a hinged door 1001 and a notification device 1003.

In the contemplated embodiment, device 1003 is preferably a hinged member 1005 that is configured to move between two locations. FIG. 10 illustrates the first position, wherein device provides notification that no documents are ready for pickup. Device 1003 includes a first securing device 1007 that attaches to a front surface area 1009 and a second securing device 1011 that is attached to member 1005 and configured to secure member 1005 to a surface 1013. During operation, the hinged member 1005 moves out in direction A, as indicated by an arrow.

Figure 11:
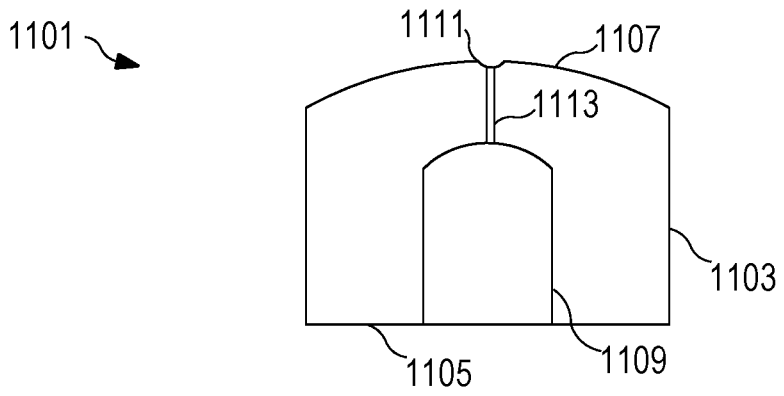
FIG. 11 is a front view of a diverter in accordance with an alternative embodiment of the present application.
Figure 12:
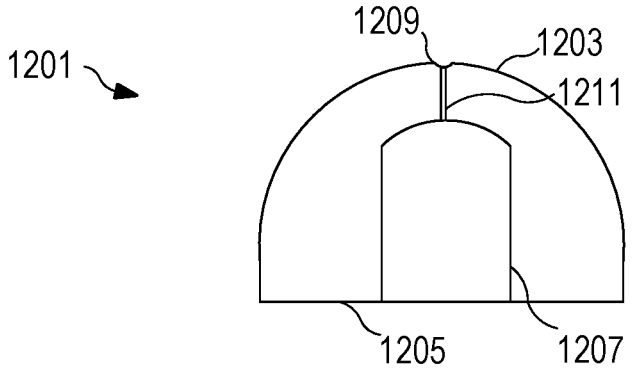
FIG. 12 is a front view of a diverter in accordance with an alternative embodiment of the present application.

Referring now to FIGS. 11 and 12 in the drawings, front views of two different diverters are shown in accordance with alternative embodiments of the present application. It will be appreciated that diverters 1101 and 1201 are substantially similar in function to diverter 709 and hereby incorporate the features discussed herein with respect to diverter 709 and vice-versa.

In the exemplary embodiment, diverter 1101 includes a side wall 1103 integral with a bottom wall 1105 and top wall 1107. In the contemplated embodiment, side wall joins at a 90 degree angle relative to the bottom wall 1105 and top wall has a curved shape. Diverter 1101 forms an opening 1109 configured to receive the mailbox (not shown) therein.

Diverter 1101 is further provided with one or more grooves 1111 extending within the thickness of diverter 1101 and configured to channel fluid. In communication with groove 1111 is a channel 1113 that extends from opening 1109 to top surface 1107. During use, the diverter 1101 is configured to divert water from the mailbox via the grooves 1111 and also configured to allow airflow and water passage via channels 1113. This feature allows the mailbox to dry and stay dry, thereby reducing rusting.

Referring specifically to FIG. 12, diverter 1201 includes a top surface 1203 that joins with a bottom surface 1205. In the contemplated embodiment, top surface 1203 is curved and integrally joins a linear bottom surface 1205. Diverter 1201 forms an opening 1207 configured to receive the mailbox (not shown) therein.

Like diverter 1101, diverter 1201 is provided with one or more grooves 1209 on surface 1203 and one or more channels 1211 in communication with the grooves 1209. As discussed, this configuration allows the mailbox to stay dry.

It will be appreciated that alternative embodiments of the diverter could include different shapes and sizes, depending on the design choice. As discussed above, the features of diverters 1101 and 1201 incorporate the features of the mailbox assemblies discussed above. Thus, the supports discussed above are tailored for the geometric shapes of the diverters 1101, 1201 to retain the mailbox in a fixed position on the mailbox support.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The particular embodiments disclosed above are illustrative only, as the invention may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A mailbox assembly for a mailbox support structure, comprising:

a retainer configured to secure a mailbox to the support structure;

a waterproof diverter positioned above the mailbox and configured to divert water away from the mailbox;

a first sleeve slidingly engaged with the mailbox and the retainer; and a second sleeve spaced apart from the first sleeve;

wherein the first sleeve is configured to secure the mailbox to the retainer in a snug position while also allowing the mailbox to slidingly engage with the retainer;

wherein the first sleeve and the second sleeve form a gap; and wherein the gap enables airflow around the mailbox.

2. The assembly of claim 1, wherein support structure is composed of brick material.

3. The assembly of claim 1, wherein the support structure forms a cavity; and wherein the retainer is configured to secure the mailbox within the cavity.

4. The assembly of claim 1, the diverter, having:

a groove configured to channel water.

5. The assembly of claim 4, the diverter, having:

a channel in communication with the groove and configured to channel water.

6. The assembly of claim 1, wherein the diverter is composed of STRYOFOAM material.

* * * * *